US011131091B2

(12) United States Patent
Herfurth et al.

(10) Patent No.: US 11,131,091 B2
(45) Date of Patent: Sep. 28, 2021

(54) DRYWALL CONSTRUCTION SYSTEM WITH SPRING RAIL

(71) Applicant: KNAUF GIPS KG, Iphofen (DE)

(72) Inventors: Dominik Herfurth, Iphofen (DE); Volker Mueller, Kitzingen (DE)

(73) Assignee: KNAUF GIPS KG, Iphofen (DE)

( * ) Notice: Subject to any disclaimer, the term of this patent is extended or adjusted under 35 U.S.C. 154(b) by 0 days.

(21) Appl. No.: 16/311,790

(22) PCT Filed: Apr. 25, 2017

(86) PCT No.: PCT/EP2017/000517
§ 371 (c)(1),
(2) Date: Dec. 20, 2018

(87) PCT Pub. No.: WO2018/001539
PCT Pub. Date: Jan. 4, 2018

(65) Prior Publication Data

US 2019/0211550 A1 Jul. 11, 2019

(30) Foreign Application Priority Data

Jun. 30, 2016 (DE) ..... 102016007912.6

(51) Int. Cl.
*E04H 1/00* (2006.01)
*E04B 2/74* (2006.01)

(52) U.S. Cl.
CPC ..... *E04B 2/7409* (2013.01); *E04B 2/7457* (2013.01)

(58) Field of Classification Search
None
See application file for complete search history.

(56) References Cited

U.S. PATENT DOCUMENTS 1,675,226 A * 6/1928 Munroe ..... E04B 2/58 52/363
2,281,951 A * 5/1942 Schroeder ..... F27D 1/004 52/479
2,553,363 A * 5/1951 Droeger ..... E04B 1/86 52/145
3,064,772 A * 11/1962 Clay ..... E04B 1/80 174/138 R
3,090,164 A 5/1963 Nelsson
3,333,379 A * 8/1967 Harris ..... E04F 13/0803 52/346

(Continued)

FOREIGN PATENT DOCUMENTS

RU 2317378 2/2008

OTHER PUBLICATIONS

International Preliminary Report on Patentability for International (PCT) Patent Application No. PCT/EP2017/000517, dated Jan. 1, 2019, 5 pages.

(Continued)

*Primary Examiner* — Basil S Katcheves
(74) *Attorney, Agent, or Firm* — Sheridan Ross P.C.

(57) ABSTRACT

The invention relates to a drywall construction system comprising a plurality of metal profiles which at least on one side are panelled using dry construction boards. At least on this one side spring rails are arranged between the metal profiles and the dry construction boards. The invention is suitable, in particular, for improving sound insulation in lightweight steel constructions.

20 Claims, 2 Drawing Sheets

(56) References Cited

Figure 1A:
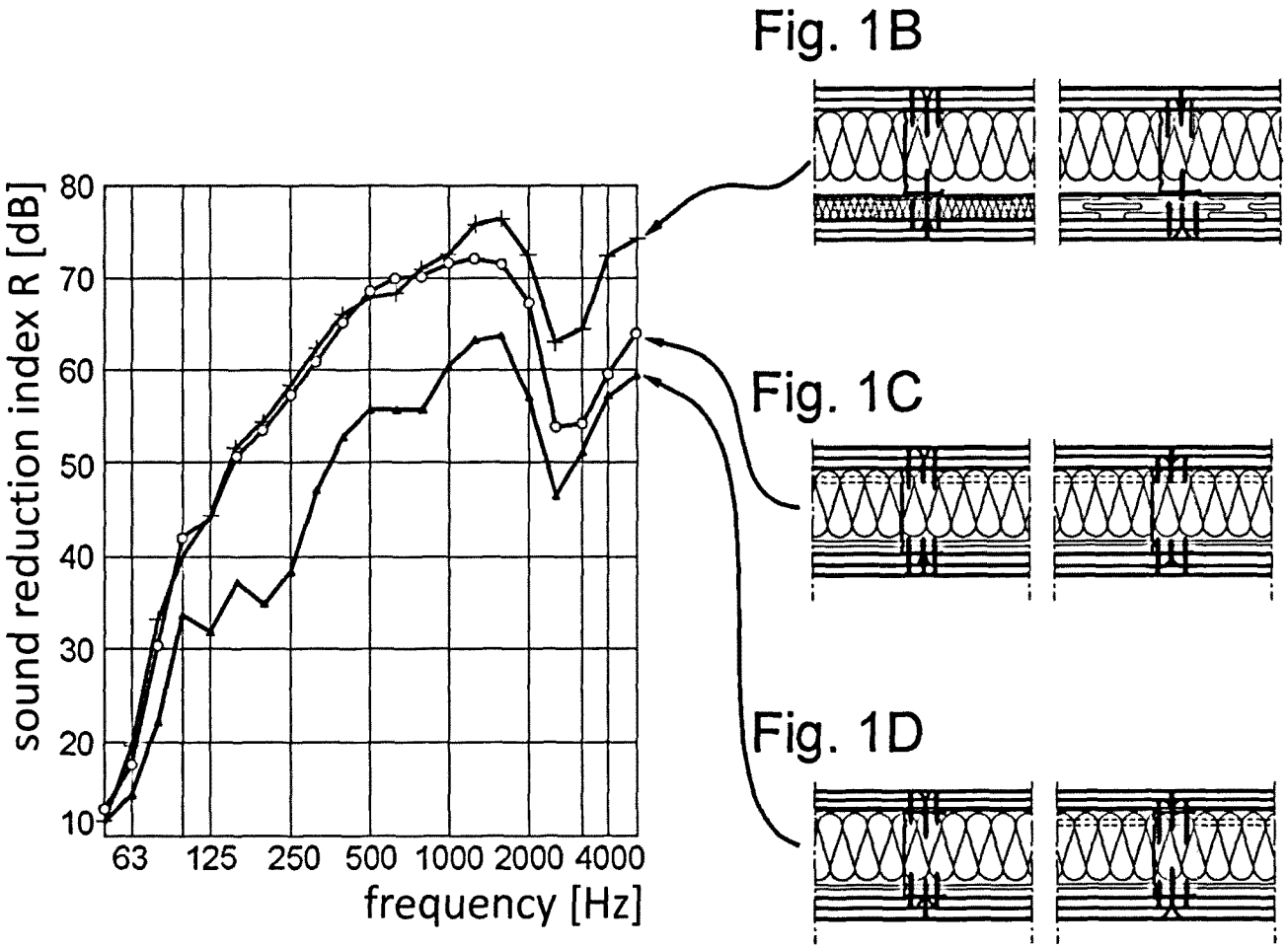

U.S. PATENT DOCUMENTS 3,421,281 A * 1/1969 Harris ..... E04F 13/0803 52/483.1
3,477,187 A * 11/1969 Fruman ..... E04F 13/0803 52/346
3,681,881 A * 8/1972 Baran ..... E04F 13/0835 52/29
4,152,878 A * 5/1979 Balinski ..... E04B 1/941 52/481.1
4,266,384 A * 5/1981 Orals ..... E04B 9/22 52/407.1
4,660,339 A * 4/1987 Paz ..... E04F 13/0803 52/238.1
5,440,854 A * 8/1995 Hohmann ..... E04B 1/4178 52/379
5,911,663 A * 6/1999 Eidson ..... E04D 3/3608 52/409
5,930,968 A * 8/1999 Pullam ..... E04C 3/32 52/481.1
6,226,947 B1 * 5/2001 Bado ..... E04F 19/06 52/483.1
6,425,219 B1 * 7/2002 Barmak ..... E04B 2/7425 52/238.1
6,601,349 B1 * 8/2003 Corden ..... E04B 2/7453 52/126.4
7,185,460 B2 * 3/2007 Corden ..... E04B 2/7453 52/220.7
7,191,570 B1 * 3/2007 Eaton ..... E04B 9/22 52/465
D580,260 S * 11/2008 Collins ..... D8/382
7,797,905 B1 * 9/2010 Smalley ..... E04B 7/024 52/478
8,714,495 B2 * 5/2014 Myers ..... F16B 2/12 248/74.1
8,769,901 B2 * 7/2014 Todd ..... E04F 13/0805 52/483.1
9,140,007 B2 * 9/2015 Beaty ..... E04B 2/16
9,243,399 B2 * 1/2016 Kubassek ..... E04B 1/40
2007/0245933 A1 * 10/2007 Kramer ..... E04B 2/7457 109/49.5
2009/0283359 A1 * 11/2009 Ravnaas ..... E04B 1/82 181/286
2011/0146180 A1 6/2011 Klein
2014/0305736 A1 * 10/2014 Gates ..... E04B 1/8209 181/284
2016/0177559 A1 * 6/2016 Ohlsson ..... E04F 13/04 52/699

OTHER PUBLICATIONS

International Search Report and Written Opinion prepared by the European Patent Office dated Jul. 5, 2017, for International Application No. PCT/EP2017/000517.
Official Action for Russian Patent Application No. 2018140762/03, dated Apr. 14, 2020, 4 pages.

* cited by examiner

DRYWALL CONSTRUCTION SYSTEM WITH SPRING RAIL

CROSS REFERENCE TO RELATED APPLICATIONS

This application is a national stage application under 35 U.S.C. 371 and claims the benefit of PCT Application No. PCT/EP2017/000517 having an international filing date of 25 Apr. 2017, which designated the United States, which PCT application claimed the benefit of German Patent Application No. 10 2016 007 912.6 filed 30 Jun. 2016, the disclosure of each of which are incorporated herein by reference.

The invention relates to a drywall construction system with spring rails. In particular the invention relates to a drywall construction system with sound insulation properties, in which spring rails are arranged between the metal supports and the panelling.

Drywall construction systems which also meet sound insulation requirements are known from the art. The sound insulation properties of lightweight walls constructed from metal posts and beams with panelling on both sides are essentially determined by the so-called mass-spring-mass principle. Speaking in generalised terms, the following two statements apply:

1) The heavier (increase in the masses in the mass-spring-mass system) and the more flexible the boards of the panelling layers are, the better is the sound insulation of the wall.
2) The better the acoustic decoupling of the opposing panel layers is (e.g. due to flexible, spring-elastic metal supports), the better is the sound insulation of the wall (reduced spring stiffness in the mass-spring-mass system).

An example for a high-performance sound-Insulation wall system based on these principles, is the W112 Knauf wall system with two-layer panelling on both sides using Knauf Diamant Boards (gypsum plasterboards with a raw density of >1000 kg/m$^3$) of 12.5 mm nominal thickness as well as a substructure of CW 100/50/06 Knauf Profiles ("acoustic"-C-Profile with good springiness or resilience for the wall) at an axial distance of 625 mm and cavity sound-proofing with mineral wool with a filling level of 80%. This construction achieves a sound reduction index Rw of 63.2 dB on the test bench.

Such a wall system, however, cannot cope with any systematic building loads, because the CW profiles (100/50/06 profile) with a steel sheet thickness of only 0.6 mm are structurally unsuitable for this. A load-bearing wall requires profiles with a greater sheet thickness, such as the C 97/50/1.5 Cocoon profile. This lightweight steel profile has a sheet steel thickness of 1.5 mm. When using this profile with an otherwise unchanged wall design, the sound reduction index deteriorates significantly to a test bench value of only Rw 51.1 dB. The reduction in sound insulation is caused by the use of C 97 profiles with greater sheet thickness.

The greater sheet thickness of the C 97 profiles leads to a distinct increase in spring stiffness as compared to the CW 100 profiles used in dry construction systems taking into account the acoustics, the CW 100 profiles having a sheet thickness of only 0.6 mm.

Furthermore a spring rail or resilient bar is known in the art, which is used in the field of loft conversions with wooden frames where the spring rails are to compensate for the high acoustic stiffness of the wooden frames, in order to achieve sufficient sound insulation. To our knowledge, however, this spring rail is used exclusively in this area.

The object of the invention consists in proposing a drywall construction system with improved sound insulation, in particular in areas, where load-bearing walls are constructed according to the drywall principle (lightweight steel construction).

This object is achieved by means of a drywall construction system for sound insulation according to claim 1. Advantageous further developments of the invention are specified in the sub-claims.

The drywall construction system according to the invention comprises a plurality of metal profiles, which are clad with panels, at least on one side, using dry construction boards. Spring rails are arranged between the metal profiles and the dry construction boards at least on this one side. The spring rails acoustically decouple the panelling of the drywall construction system from the profiles, thereby strengthening the spring effect in the above described mass-spring-mass system.

The metal profiles are preferably lightweight steel profiles with a sheet thickness between 1 mm minimum and 3 mm maximum. Preferably the sheet thickness is greater than 1.5 mm and a maximum of 3 mm. These profiles are suitable for use in load-bearing structures. Due to their high sheet thickness, however, they are comparatively stiff against bending, and therefore additional sound-insulation measures are required in order to comply with today's sound-insulation standards. The decoupling, which is due to the spring rails arranged between the profiles and the panelling, compensates for the acoustic disadvantage of higher sheet thicknesses, in fact, it overcompensates for it.

The drywall construction system according to the invention with use of the spring rail as a decoupling element can be used to advantage also in conventional drywall construction systems. The metal profiles used here are so-called spring profiles, which have particularly good acoustic properties. The sheet thickness of these spring profiles is between 0.4 mm and 1 mm. Due to using the spring rail between these spring profiles and the dry construction boards used for the panelling a further increase in the sound reduction index can be achieved.

According to a particularly preferred embodiment of the invention the spring rail is a top-hat rail. It comprises a base with shanks adjacent to the base on both sides, wherein the shanks project at an angle from the base. The shanks are joined to flanges, which again extend at an angle therefrom.

The flanges and the base are used to attach the spring rail to the metal profile/the construction board. The angled shanks provide for the spring effect of the spring rail.

The spring rail preferably comprises recesses in the metal. The recesses lead to a higher flexibility of the spring rail and to less contact between the spring rail and the metal profile, and thus further improve the decoupling between the metal profiles and the panelling. Particularly preferably the recesses may be provided in the vicinity of the shanks. A round or oval shape of the recesses is particularly preferable because it promotes a particularly good relationship between stability and flexibility of the rail.

The drywall construction system is suitable for both one-sided and two-sided panelling using dry construction boards. A one-sided panelling system is predominantly used as a facing shell in an already existing construction. Panelling on both sides or on two sides is, for example, used, when (load-bearing) partitions are to be constructed. Furthermore such systems are suitable also for use in modular construction systems, both for constructing partitions and for constructing outside walls.

According to a typical embodiment of the invention the spring rails are arranged perpendicularly to the metal profiles. The construction boards can then be attached to this profile grid.

Particularly preferably the spring rails are fastened to the metal profiles, for example they can be fastened by means of screws to the flanges of the metal profiles. The construction boards can be fixed to the spring rails. Particularly preferably the construction boards are fixed to the spring rails in such a way that they are not fixedly connected to the metal profiles. This embodiment allows for a maximum decoupling of the construction boards from the metal profiles and therefore also results in the highest sound reduction index which can be achieved with this system. Admittedly, however, stability by comparison is less with this system, and therefore the other embodiments cannot be excluded from the invention.

According to a further development of the invention the cavities can be filled with insulation material in order to increase sound insulation further. The insulation materials are placed into the cavity enclosed by the spring rails and into the cavity between the spring rails. Besides or in addition, it is possible the dispose insulation materials between the metal posts and thus fill the cavity between the boards wholly or at least partially with insulation material. Particularly preferably up to 80% by volume of the space between the dry construction boards is filled with insulation material.

Mineral wool is a preferred insulation material in terms of this invention. But other acoustically effective insulation materials can be equally used or used in combination with each other.

Figure 2:
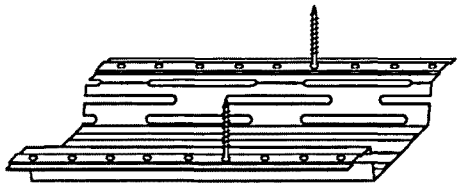
Figure 3:
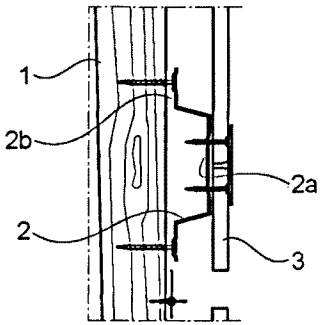

The invention will now be described in more detail by way of an exemplary embodiment, in which:

FIG. 1A shows an airborne sound reduction index in dependence of the frequency for various drywall construction systems FIG. 1B shows a schematic cross-section through a drywall construction system according to the invention FIG. 1C shows a schematic cross-section through a commonly used drywall construction system with sound insulation properties FIG. 1D shows a schematic cross-section through a drywall construction system built of lightweight steel FIG. 2 shows an oblique top view onto a part of a spring rail FIG. 3 shows a schematic section through an installed situation according to the invention.

FIG. 1 shows the sound reduction index R in dependence of the frequency for different drywall construction systems. In FIGS. 1B to 1D the respective drywall construction systems are shown schematically in horizontal section. FIG. 1C shows a commonly used drywall construction system optimised for sound insulation, which consists of metal profiles as commonly used in drywall construction systems with double-sided, two-layer panelling (profiles with a sheet thickness of 0.6 mm). The inner cavity between the metal profiles is filled to 80% by volume with mineral wool. All gypsum plasterboards (raw density >1000 kg/m$^3$) are screwed directly to the flanges of the metal profiles. The arrows point to the resulting respectively associated sound reduction graph for such a drywall construction system, see graph with circles.

FIG. 1D shows the same system setup as for the embodiment described for FIG. 1C, but here with lightweight steel profiles comprising a sheet thickness of 1.5 mm. The arrow points to the associated sound reduction graph, see graph with filled triangles. Compared to the sound insulation system of FIG. 1C it becomes clear that the sound insulation properties of the drywall system are diminished due to the use of lightweight steel profiles.

FIG. 1B shows an embodiment of a drywall construction system according to the invention, which is different from the embodiment shown in FIG. 1D due to the presence of spring rails extending perpendicularly to the metal profiles. The spring rails are arranged between the 1.5 mm thick lightweight steel profiles and the one side, which is panelled. The spring rails are screwed to the metal profiles at the intersecting points, whilst the gypsum plasterboards are screwed solely to the spring rails. The panelling is decoupled from the metal profiles, so that only a very small proportion of the sound energy can actually be transferred via the system to the other side. The arrow points to the sound reduction graph associated with this drywall construction system, see graph with crosses. It is evident that this system is superior especially in the high frequency range even to the sound insulation system shown in FIG. 1C. This also becomes evident when looking at the sound reduction index Rw, which is 66.4 dB for the inventive embodiment, 63.2 dB for the sound insulation variant of FIG. 1C, and only 51.1 dB for the lightweight steel variant without further measures (FIG. 1D). The negative influence of the 1.5 mm lightweight steel profiles upon the sound insulation is not just compensated for by the integration of the spring rails, but distinctly overcompensated for. Such a positive result had not been expected.

FIGS. 2 and 3 show a possible embodiment of the spring rails in the form of a top-hat profile. In the region of the flanks the spring rail has oval holes which make the rail more elastic. The bevelled flanges also comprise holes which can be used for screwing to the metal profile.

In FIG. 3 an exemplary installed situation is depicted in longitudinal section. The metal profile 1 has a top-hat rail or spring rail 2 fastened to it with screws via the two flanges 2*b*. Two construction boards 3, in this case gypsum plasterboards, are fastened with screws in a single layer to the base 2*a* of the spring rail 2. The screws for fastening the gypsum plasterboards fix the plasterboards to the spring rail 2 only, not to the metal profile 1.

What is claimed is:

1. A double sided drywall construction system comprising:

a plurality of vertically oriented C-shaped metal profiles having first and second spaced flanges directly extending from and interconnected by a web portion with a metal sheet thickness of between 1 mm and 3 mm;

a first plurality of top-hat shaped spring rails attached at a perpendicular orientation to at least some of the first flanges of the plurality of metal profiles, the first plurality of top-hat shaped spring rails including one or more recesses;

a first plurality of plasterboards having a raw density greater than 1000 kg/m$^3$ directly attached to the first plurality of top-hat shaped spring rails, wherein the first plurality of plasterboards are spaced from and not directly attached to the plurality of metal profiles and the first plurality of top-hat shaped spring rails are arranged between the metal profiles and the first plurality of plasterboards;

a second plurality of plasterboards having a raw density greater than 1000 kg/m$^3$ directly attached to at least some of the second flanges of the plurality of C-shaped profiles, wherein at least one of the first and second plurality of plasterboards comprise a first layer of plasterboard connected to a second layer of plasterboard; and insulation positioned in the cavity defined between the first and second plurality of plasterboards.

2. The double-sided drywall construction system according to claim 1, wherein the metal profiles have a sheet thickness between 1.5 mm and 3 mm.

3. The double-sided drywall construction system according to claim 1, wherein the top-hat shaped spring rails comprise a base having first and second parallel side edges, a first shank extending from the first edge and a second shank extending from the second edge and a plurality of recesses positioned in at least the first and second shanks, a first flange extending from the first shank and a second flange extending from the second shank, wherein the first and second flanges are co-planer, and at least one recess having a curved perimeter edge disposed on the first shank and at least one recess having a curved perimeter edge disposed on the second shank.

4. The double-sided drywall construction system according to claim 1, wherein at least one of the first plurality of spring rails is fastened to each of the plurality of metal profiles.

5. The double-sided drywall construction system according to claim 1, wherein up to 80% by volume of the cavity between the first plurality of plasterboards and the second plurality of plasterboards is filled with an insulation material.

6. The double-sided drywall construction system according to claim 1, wherein the sheet thickness is 1.5 mm.

7. The double-sided drywall construction system of claim 1, wherein the plurality of metal profiles, the first and second plurality of plasterboards and the first plurality of spring rails comprise a load bearing partition wall.

8. The double-sided drywall construction system according to claim 1, wherein the first plurality of top-hat shaped spring rails are oriented horizontally.

9. The double-sided drywall construction system according to claim 1, wherein a sound reduction index of greater than 73 dB for frequencies greater than 1000 Hz and less than 2000 Hz is provided.

10. The double-sided drywall construction system according to claim 1, wherein a sound reduction index of greater than 70 dB for frequencies greater than 4000 Hz is provided.

11. A drywall system, comprising:

a load bearing partition wall having a plurality of metal profiles vertically oriented in a spaced relationship, each metal profile having at least a first outwardly facing side flange and a second outwardly facing side flange extending from and interconnected by a web portion, wherein the first and second side flanges face different directions, and each metal profile having a sheet metal thickness of 1.5 mm;

a first plurality of sound decoupling top-hat shaped spring rails directly attached at a perpendicular orientation to each of the first side flanges of the plurality of metal profiles;

a first plurality of plasterboards having a raw density greater than 1000 kg/m$^3$ directly attached to the plurality of sound decoupling spring rails and spaced from and not directly attached to a metal profile, wherein the first plurality of sound decoupling spring rails are arranged between the first side of the metal profiles and the first plurality of plasterboards; and a second plurality of plasterboards having a raw density greater than 1000 kg/m$^3$ directly attached to at least some of the second side flanges of the plurality of metal profiles;

a cavity defined between the first and second plurality of plasterboards, wherein an insulation material is positioned in the cavity; and wherein, the drywall system provides a sound reduction index of greater than 73 dB for frequencies greater than 1000 Hz and less than 2000 Hz.

12. The drywall system of claim 11, wherein the first and second side flanges face in opposite directions.

13. The drywall system of claim 11, wherein, a sound reduction index of greater than 70 dB of sound reduction for frequencies greater than 4000 Hz is provided.

14. The drywall system of claim 11, wherein at least one of the first and second plurality of plasterboards comprise a first layer of plasterboard connected to a second layer of plasterboard.

15. The drywall system of claim 11, wherein the plurality of metal profiles are C-shaped.

16. The drywall construction system of claim 11, wherein the plurality of sound decoupling top-hat shaped spring rails each comprise a base having first and second parallel side edges, a first shank extending from the first edge and a second shank extending from the second edge and a plurality of recesses having a perimeter edge that is curved along at least a portion of the edge and positioned in at least the first and second shanks, a first flange extending from the first shank and a second flange extending from the second shank.

17. A drywall construction system, comprising:

a plurality of vertically oriented metal profiles having first and second spaced flanges directly extending from and interconnected by a web portion and having a sheet thickness between 1 mm and 3 mm;

a plurality of top-hat shaped metal spring rails each having a base having a first edge and a second edge spaced from the first edge, a first shank extending from the first edge of the base at an angle relative to the base, a second shank extending from the second edge of the base at an angle relative to the base, a first flange extending from the first shank at an angle relative to the first shank, and a second flange extending from the second shank at an angle relative to the second shank, at least one recess formed in each shank, the plurality of spring rails having a first open end and a spaced second open end spaced from the first open end, wherein the first and second shanks and base of each metal spring rail define a cavity and wherein the length between the first and second open end of the spring rails defines a longitudinal dimension of the spring rails, the plurality of spring rails fastened to the plurality of metal profiles and oriented wherein the longitudinal dimension of the spring rails is perpendicular to the longitudinal dimension of the metal profiles, and wherein the spring rails are fastened to at least one of the first and second flanges of the metal profiles;

a first plurality of dry construction boards mounted to the first side of the plurality of metal profiles, a second plurality of dry construction boards mounted to a plurality of spring rails fastened to the second side of the plurality of metal profiles, the first and second plurality of dry construction boards having a raw density of greater than 1000 kg/m$^3$;

insulation disposed within each cavity of the plurality of spring rails.

18. The drywall construction system of claim 17, wherein a space is formed between the first and second plurality of dry construction boards, and the space is filled at least eighty percent by volume with insulation.

19. The drywall construction system of claim 17, wherein at least one of the first and second plurality of dry construction boards comprise a first layer of dry construction board connected to a second layer of dry construction board.

20. The drywall construction system of claim 17, wherein a cavity is formed between the first plurality of dry construction boards and the second plurality of dry construction boards and the cavity is filled with up to eight percent by volume of an insulation material.

* * * * *